US005778562A

United States Patent [19]

Karl-Heinz

[11] Patent Number: 5,778,562

[45] Date of Patent: Jul. 14, 1998

[54] INSERT FOR A SHOE

[75] Inventor: Lory Karl-Heinz, Augsburg, Germany

[73] Assignee: Lory Orthopadie Schuhtechnik Gesundheitsforum Service Und Handels, Augsburg, Germany

[21] Appl. No.: 542,470

[22] Filed: Oct. 12, 1995

[30] Foreign Application Priority Data

Oct. 18, 1994 [DE] Germany ..... 44 37 282.5

[51] Int. Cl.[6] ..... A43B 13/38

[52] U.S. Cl. ..... 36/44; 36/174; 36/178

[58] Field of Search ..... 36/44, 37, 173, 36/174, 176, 178

[56] References Cited

U.S. PATENT DOCUMENTS

| | | | |
|---|---|---|---|
| 1,867,431 | 7/1932 | Wood | 36/44 |
| 2,037,970 | 4/1936 | Everston | 36/44 X |
| 2,119,807 | 6/1938 | Farley | 36/37 |
| 2,546,408 | 3/1951 | Riggs | 36/178 |
| 2,660,814 | 12/1953 | Ritchey | 36/37 X |
| 5,146,698 | 9/1992 | Tiles et la. | 36/44 |
| 5,174,052 | 12/1992 | Schoenhaus et al. | 36/176 X |
| 5,216,825 | 6/1993 | Brum | 36/44 |

FOREIGN PATENT DOCUMENTS

| | | | |
|---|---|---|---|
| 57330 | 1/1953 | France | 36/178 |
| 1437697 | 3/1966 | France | 36/44 |
| 0156403 | 8/1985 | Japan | 36/44 |

*Primary Examiner*—Ted Kavanaugh

*Attorney, Agent, or Firm*—Knobbe, Martens, Olson & Bear, LLP

[57] ABSTRACT

The invention relates to a process for the manufacture of an orthopedic support in shoes, in the case of which the top-part is provided along its borders with a continuous cut-out section, so that for the final form-imparting processes of the orthopedic support, merely a border-part and a bottom-part have to be subjected to the grinding operations. This ensures that, also after longer usage, the orthopedic support shows a stability of form, since a material thickness of only a small order of magnitude has to be subjected to the grinding operations, and in that consequently, the border-sections in the upper region of the orthopedic support, retain their retractility.

7 Claims, 4 Drawing Sheets

INSERT FOR A SHOE

FIELD OF THE INVENTION

The invention relates to a process for the manufacture of an orthopedic support in shoes.

BACKGROUND OF THE INVENTION

It is true, that by using a process such as the one known from DE-PS No. 3,701,950, an orthopedic support with a low degree of pressure-point-friction in the marginal area can be created, however, problems such as the ones cited in the following, manifested themselves. Since the bottom part, the formed part and the top part are in each case joined together in a superimposed manner during the manufacture of the orthopedic support, a material-thickness of a relatively large order of magnitude is created over the entire marginal area of the orthopedic support after the compression process. This material-thickness has to be reduced by means of a grinding process. However, investigations carried out within the framework of the invention have shown that, during the grinding process, so much material has to be removed, with the result that the upper marginal area is weakened to a very great extent, which negatively influences its stability of shape and its retractility.

SUMMARY OF THE INVENTION

It is therefore the task of the present invention to create a process for the manufacture of an orthopedic support in shoes namely a process with the help of which it is possible, in a simple manner, to create an orthopedic support, the upper marginal area of which displays a stability of shape after the grinding process and does not tend to become frayed.

This problem is solved by a manufacturing process for an orthopedic support for shoes, including cutting to size of a preferably foot-cushion-like formed bottom-part, a full-sole-like top-part for the support of the sole of the foot, and a border-part. The process further includes assembling of the bottom-part, the border-part and the top-part in a vacuum-press, while resting on a last or on a plaster-mold, wherein when the top-part is cut to size, a cut-out section is created at least along a part of the lateral-margins and along the heel-margin.

It is achieved hereby, that the top-part of the orthopedic support does not extend into the upper marginal area after the components are joined together, so that merely the bottom-part and the border-part have to be subjected to the grinding process in the course of the final processing step. On the one hand, the advantage results that only a slight quantity in material has to be removed during the grinding process since in its entire marginal area, the orthopedic support due to the material removal from the top-part displays a thickness of a lesser order of magnitude. On the other hand, the advantage results that merely the bottom-part and the border-part have to be subjected to the grinding process, which components display a high degree of retractility and consequently display a stability of shape, so that, after completion of the orthopedic support, the latter displays a stability of shape over longer periods of time, and, furthermore, shows a clear-cut contour of its marginal area, without danger of becoming frayed.

Advantageous further development of invention may include one or more of the process steps of: preheating the border-part and the top-part in the absence of an adhesive; providing the bottom-part with an adhesive prior to the forming operation; grinding the composite of parts to its final shape; applying an upper layer onto the top-part; providing a border-part which displays a U-shaped contour, which in form and dimension corresponds to those of the cut-out section of the top-part; designing the border-part as a closed ring which delineates an insertion-recessed-area; cutting out the section around the top-part along its borders in such a manner so that it corresponds in form and dimension to the insertion-recessed-area; arranging a reinforcement component which, in form and dimension, corresponds to those of the top-part between the bottom-part and the top-part; and placing an intermediary layer made of textile material between the top-part and the reinforcement-component.

In an advantageous manner, the bottom-part, the border-part and the top-part are first cut to size, whereby in the case of a particularly preferred form of execution, the continuous cut-out section extends from the heel-region into the area ranging from the first to the fifth metatarsal-bone-head.

The invention furthermore relates to an orthopedic support for shoes with a bottom-part and a top-part for the sole of the foot, comprising a border-part, which at least can be connected with the bottom-part, wherein the top-part along its border is provided with a cut-out section which preferably extends up to the region of the first to the fifth metatarsal-bone-head. The orthopedic may have a cushion-like member arranged between the top-part and the border-part, and an upper-layer may be applied onto the top-part. The border-part may be designed as a closed ring which delineates an insertion-recessed-area, and the top-part, in its form and dimension, may correspond to the form and dimension of the insertion-recessed-area. Further, a reinforcement-component which, in form and dimension, corresponds to those of the top-part may be arranged between the bottom-part and the top-part, and an intermediary layer made of textile material may be placed between the top-part and the reinforcement-component.

BRIEF DESCRIPTION OF THE DRAWINGS

Further details, characteristics and advantages of the invention become apparent from the following description of three exemplified embodiments while making reference to the drawings.

DESCRIPTION OF THE PREFERRED EMBODIMENTS

Figure 1:
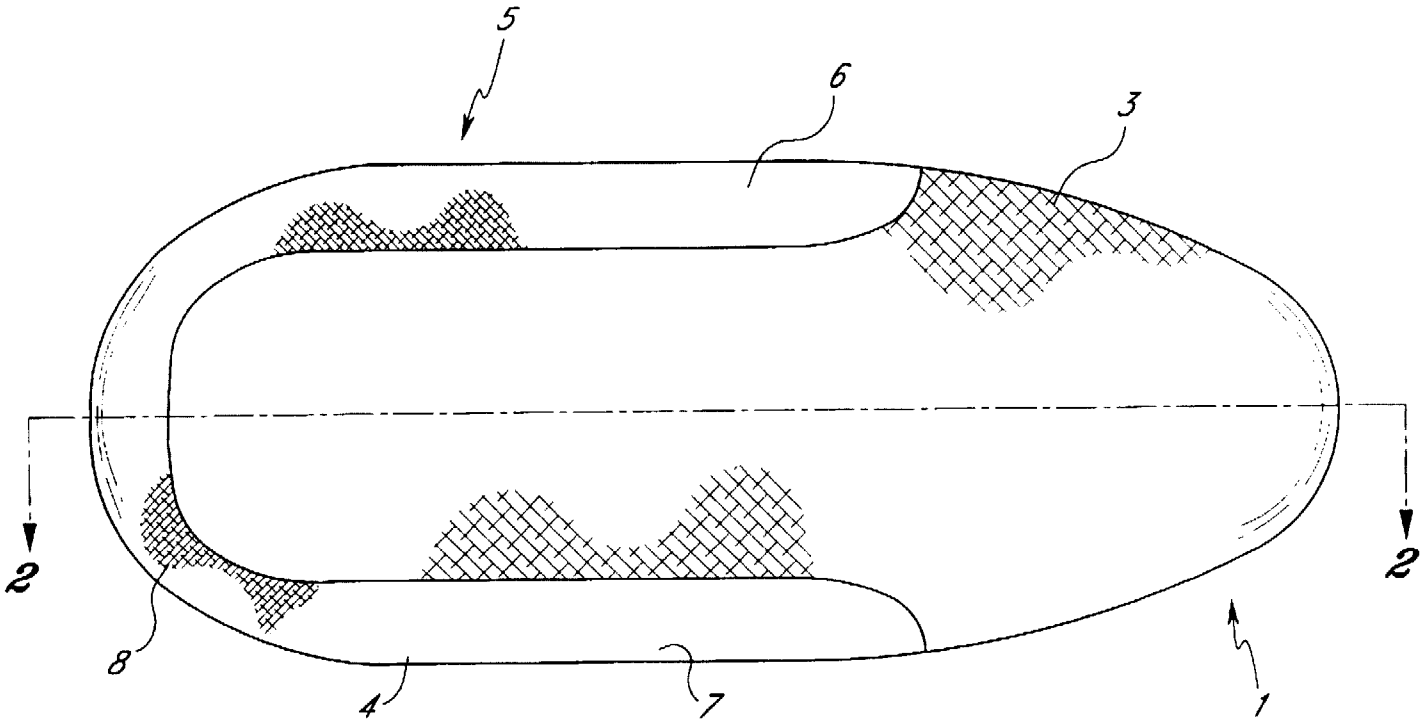
FIG. 1 is a sectional view of a layered arrangement of the top-part and of the border-part of an orthopedic support designed according to the invention.
Figure 2:
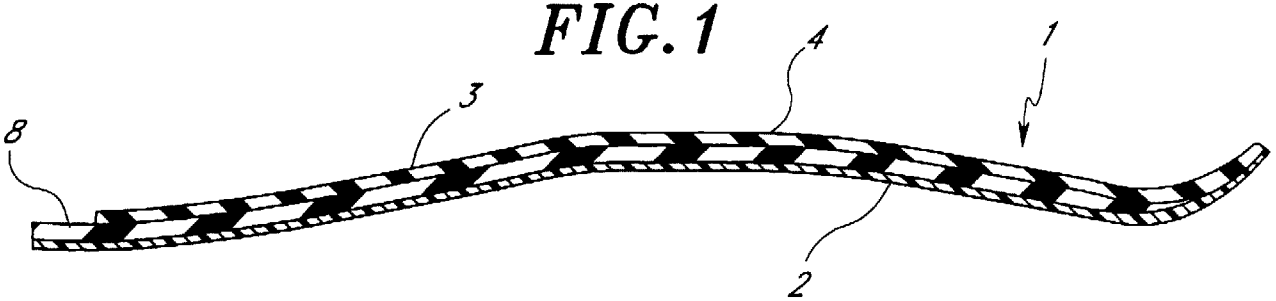
FIG. 2 is a sectional view through the arrangement along the line II—II in FIG. 1.

In FIGS. 1 and 2, the layered arrangement of an orthopedic support 1, designed according to the invention, is shown, prior to the final shaping process. Accordingly, the orthopedic support 1 displays three layers in the case of the example given here. As it can be seen from FIG. 2, the lowest layer represents a foot-cushion-like formed bottom-part 2. The uppermost layer is the top-part 3, on which the sole of the foot comes to rest. Between the layers 2 and 3, the border-part 4 is arranged, which is also referred to as the formed-part 4.

Figure 3:
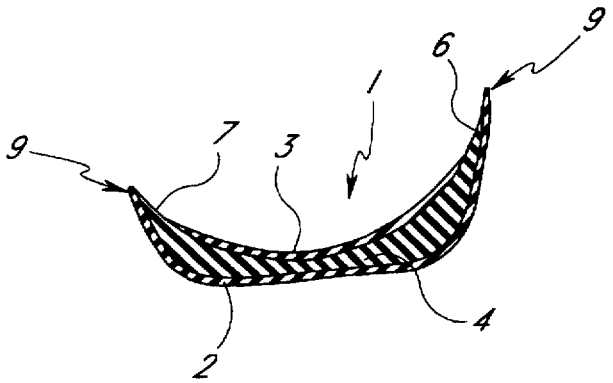
FIG. 3 is a sectional view through a finished, completely formed orthopedic support along the line III—III in FIG. 4.

The top-view onto the arrangement designed according to FIG. 3 shows that, in the case of the given example, the top-part 3 displays an unbroken cut-out section 5. The latter consists of two margin-sections 6 and 7 extending approximately parallel to one another and, in the case of the example given here, are joined together by the heel-margin-section 8 in order to form the unbroken cut-out section 5. The margin-sections 6 and 7 extend from the heel-area preferably to the region of the first to fifth metatarsal-bone-head. However, basically it is possible to design sections 6, 7 and 8 as separate cut-out sections (such as, for example, cut-out sections separated from one another by means of intermediary cross-pieces).

This layer arrangement is also once more illustrated by the sectional representation given in FIG. 3. Hereby, it has to be particularly emphasized that, by providing the cut-out area 5, one gains the advantage that, in the case of the finished, completely formed orthopedic support 1, the grinding operations of the upper marginal areas 9 and 9' are simplified, since for the final shaping-process merely the bottom-part 2 and the exposed border-part 4 in the region of the cut-out 5, have to be subjected to the grinding process. Since the border-part 4 and the bottom-part 2 display a particularly good stability of shape, marginal areas 9 and 9' result, which do not become frayed and retain their retractility, with the result that even after a longer period of utilization they guarantee a stability of shape of the entire orthopedic support 1.

Figure 4:
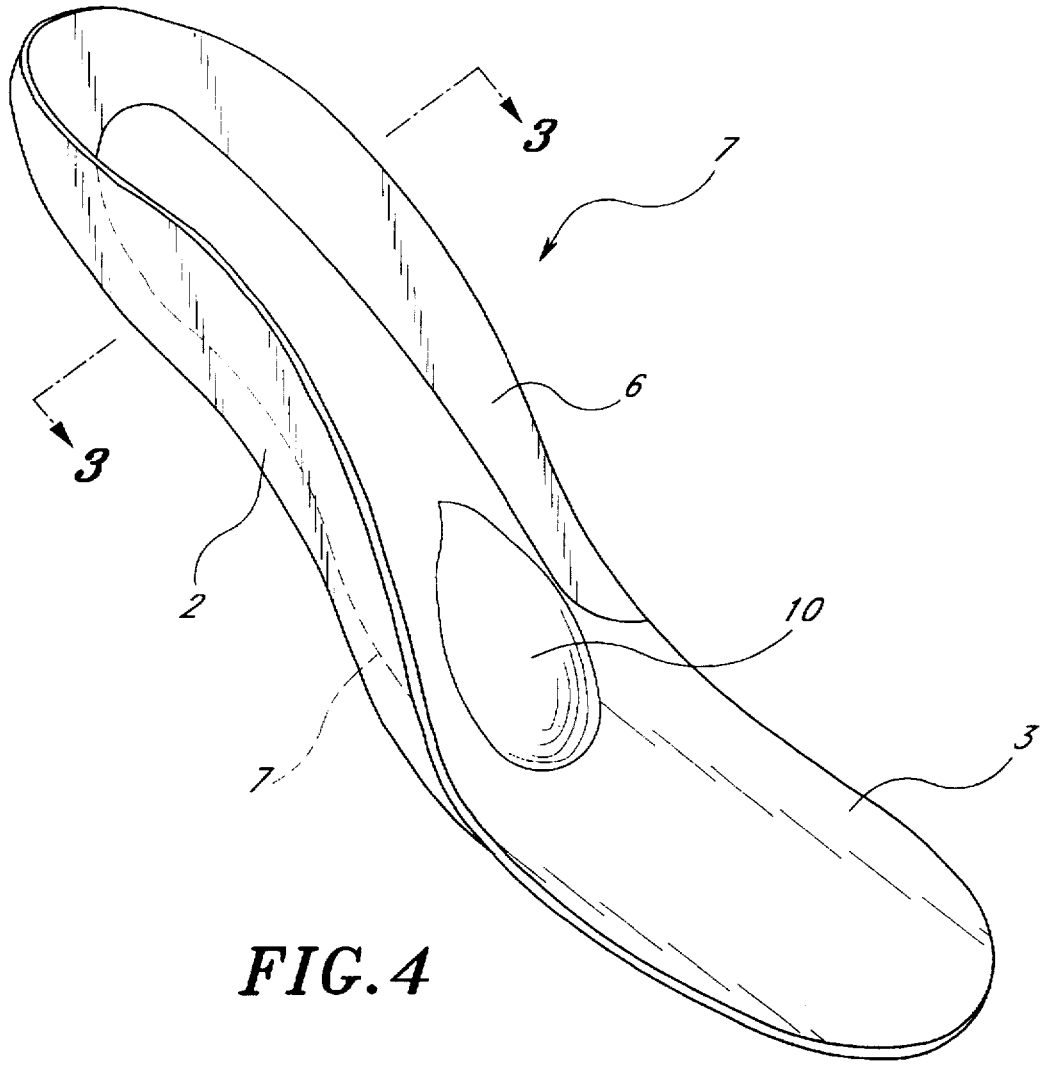
FIG. 4 shows a perspective representation of an orthopedic support designed according to the invention.

A finished, completely formed and processed orthopedic support 1 is shown in FIG. 4, in which additionally a cushion-like member 10 is indicated, which can be arranged selectively and depending on the case of application, whereby this cushion-like member 10 lies between the top-part 3 and the border-part 4.

In the case of an especially preferred exemplified embodiment of the process, one proceeds in the following manner:

To begin with, parts 2, 3 and 4 are cut to size, whereby the top-part 3 is provided with the precedingly cited cut-out section 5, resulting in the exposed marginal area of the border-part 4, visible especially in FIG. 1.

After parts 2, 3 and 4 had been cut to size, the top-part 3 and the formed-part 4 are preheated, preferably in absence of any adhesive. After the preheating process, all three parts 2, 3 and 4 are joined together, whereby the bottom-part 2 is preferably provided with an adhesive.

After these three parts 2, 3 and 4 are joined together, they are placed on a last or on top of a plaster-mold. The total assembly is then placed into a vacuum-press, in which under application of pressure and while resting on top of the last or plaster-mold they are shaped. Subsequently, a cooling process is carried out. After the cooling process, the precedingly cited grinding process into the final shape of the orthopedic support takes place.

In certain given cases, an additional layer can also be applied onto the top-part 3, for example, in form of a coating.

Figure 5A:
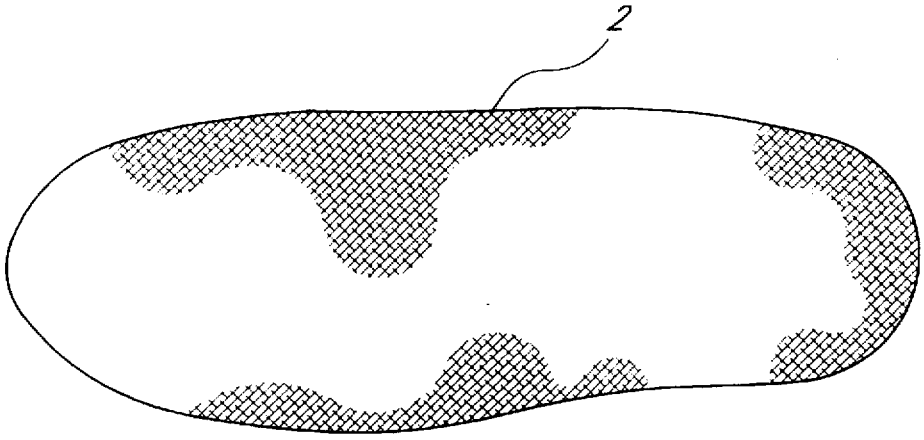
FIGS. 5*a*–5*c* show a spread-out representation of a further form of execution of an orthopedic support designed according to the invention.
Figure 5B:
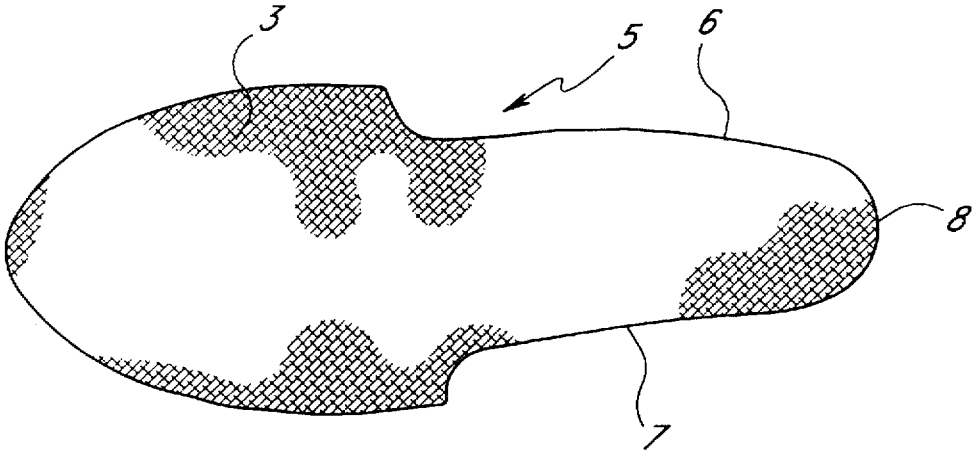
Figure 5C:
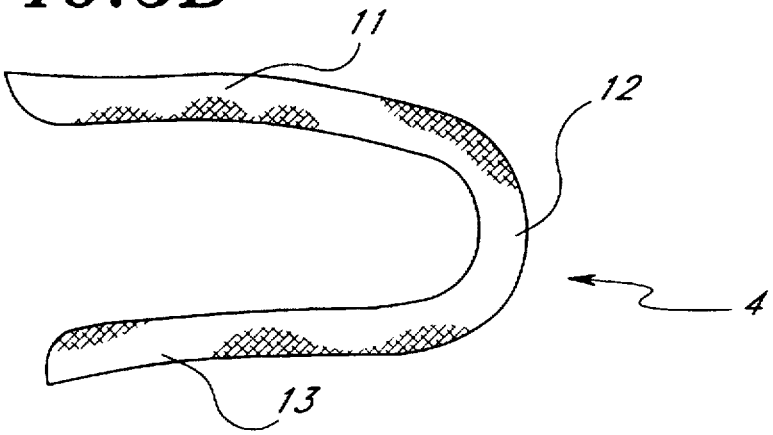

In FIGS. 5*a* to 5*c*, a further exemplified embodiment of an orthopedic support designed according to the invention is shown. In order to better illustrate the inventive principle of this form of execution, parts 2, 3 and 4 of this orthopedic support are shown here in a spread-out manner.

From FIGS. 5*a* and 5*b*, it becomes apparent that, as it concerns the makeup of parts 2 and 3, it corresponds in essence to the one of the exemplified embodiment shown in FIG. 1, so that one can point to the explanations given when FIG. 1 had been discussed. In particular, the top-part 3 again shows a cut-out area, which preferably is a continuous one, extending into the region of the first to fifth metatarsal bone head, whereby the cut-out area shown in FIG. 5*b* corresponds to that shown in the case of the exemplified embodiment of FIG. 1.

The essential difference of the form of execution in accordance with FIGS. 5*a* to 5*c* can be seen in the form of the border-part 4. As it is illustrated in FIG. 5*c*, the border-part 4 has a horse-shoe-like or U-shaped form, which in its shape and dimension is adapted to the pattern of the cut-out section 5 of the top-part 3 as show in FIG. 5*b*. Consequently, the border-part 4 displays two lateral branches 11 and 13, which in essence extend in parallel manner with respect to one another and are interconnected by means of a connecting-piece 12, resulting in a one-piece form. As it concerns their dimensions and form, the lateral branches 11 and 13 correspond to those of the lateral-margin-sections 6 and 7 of the cut-out section 5 of the top-part 3. In its form and dimension, the curved connecting-piece 12, correspondence to those of the heel-margin-section 8 of the cut-out section 5 of the top-part 3.

When the parts 2, 3 and 4 of the form of execution shown in FIGS. 5*a* to 5*c* are joined together, then a top-view of the resulting configuration, corresponds to the one shown in FIG. 1. However, the essential difference may be seen in the fact that the border-part 4 is used merely in the region of the cut-out section 5, thus displays no region which comes to lie between parts 2 and 3, as this is shown in detail in the sectional representation of FIG. 2, relating to the exemplified embodiment illustrated in FIG. 1. This results in the particular advantage that the orthopedic support designed in accordance with FIGS. 5*a* to 5*c*, can be made to be thinner, so that in turn, the advantage of a lower weight of said orthopedic support results, since the shape of the border-part 4 is restricted to the horse-shoe-like form shown in FIG. 5*c*. However, when the three parts 2, 3 and 4 are combined, the same advantages result in the upper marginal area, since merely the bottom-part and the border-part have to be ground in the last processing-step. In this respect, one can point to the description of the advantages cited with respected to the precedingly described forms of execution.

In the case of the third form of execution represented in FIGS. 6*a* to 6*d*, a foot-cushion-like formed bottom-part 2 is shown, which as it concerns its form and its dimensions and its other characteristics can be designed in corresponding manner to the precedingly described forms of execution of the orthopedic support.

Figure 6A:
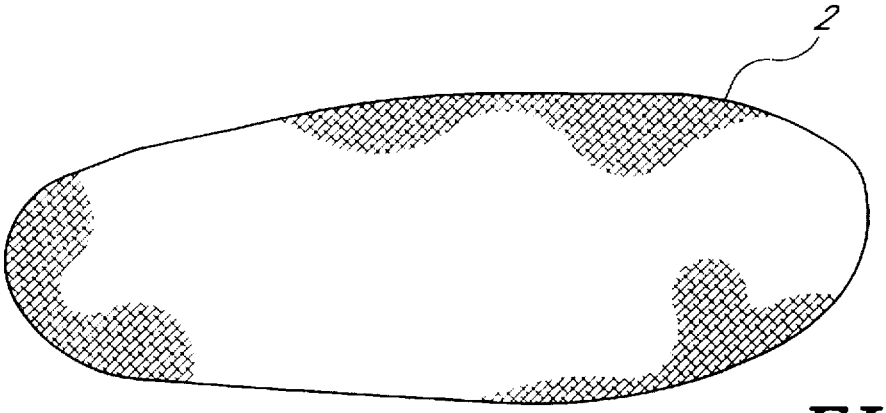
FIGS. 6*a*–6*d* show a spread-out representation of a third form of execution of an orthopedic support designed according to the invention.

This bottom-part 2 is shown in FIG. 6*a*.

Figure 6B:
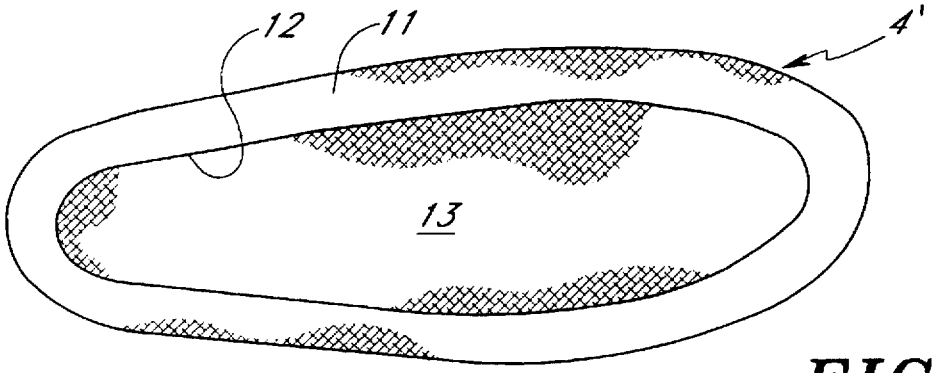

FIG. 6*b* shows an alternative form of execution of the border- or formed-part 4'. In the case of the example given here, the border-part 4' is designed as an oval-shaped unbroken ring 11. At its inner edge 12, this ring delineates an insertion-recessed-area 13. The material of the formed-part 4' can correspond to that of the precedingly described forms of execution.

Figure 6C:
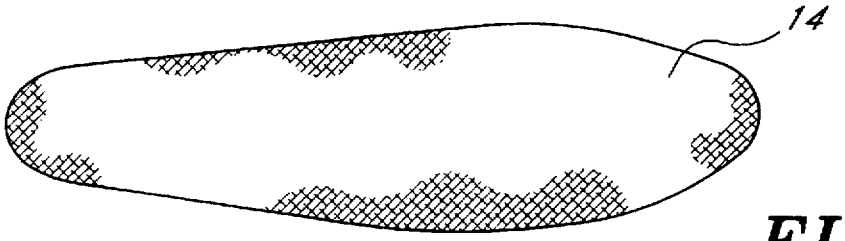
Figure 6D:
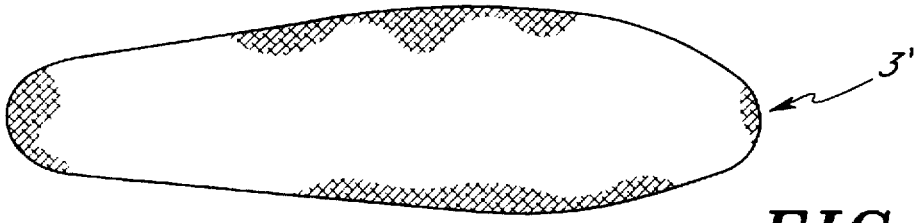

In FIG. 6*c*, a reinforcement-component 14 is shown. This reinforcement-component 14 consists in essence of a preferably very thin synthetic material, however, one is dealing here with a synthetic material which is stiffer in comparison to that of the formed-part. The component 14 is executed in form of an unbroken surface. The dimension and the form of the reinforcement-component 14 correspond to the form and to the dimension of the insertion-recessed-area 13. In other words, the reinforcement-component 14 can be exactly fitted into the insertion-recessed-area 13. In FIG. 6*d*, an alternative exemplified embodiment of the top-part 3' is shown, the material of which can correspond to that of the precedingly described form of execution. In its form and dimension, the top-part 3' corresponds to those of the reinforcement-component 14 and, thus, also corresponds to the form and the dimension of the insertion-recessed-area 13. Consequently, also the top-part 3' can be exactly fitted into the insertion-recessed-area 13. Due to the arrangement of the reinforcement-component 14, a pressure-distribution in the anterior part of the foot is possible. The part prevents the metatarsal-bone-heads from sinking-in and creates a connection from the posterior part of the foot to the anterior part of the same. Therewith, the reinforcement part 14 stabilizes the entire foot and the control of the shoe, or within the shoe, is better. Finally, the danger of falling over is prevented or reduced and a forwarding sliding in the area of the anterior foot part can likewise be reduced.

For the installation of an insertion-sole designed according to the last described third exemplified embodiment, the bottom-part 2, the border-part 4' and the top-part 3' are used as basic components. Preferably, the reinforcement component 14 is arranged underneath the top-part 3' on the bottom-part 2, namely within the insertion-recessed-area 13. In the case of a further preferred form of execution, an intermediary layer made of a textile material, is provided between the top-part 3' and the reinforcement-component 14, whereby in its form and dimension, said intermediary layer corresponds to those of the top-part 3'.

When an orthopedic support is to be manufactured with all the components which had been precedingly cited and provided-for in a preferential manner, then the border-part 4' is placed on top of the bottom-part 2. Into the insertion-recessed-area 13, one preferably first inserts the reinforcement-component 14, subsequently the intermediary layer made of textile material is placed in its position, and finally the top-part 13 is mounted. Subsequently, the precedingly cited and assembled components are joined together in the precedingly cited manner, allowing one to refer back to the precedingly cited forms of execution in this respect.

The advantage of this form of execution, in particular, lies in the fact that the total thickness of the orthopedic support decreases, since the intermediary layer can be fitted into the insertion-recessed-area.

What is claimed is:

1. An orthopedic support for shoes, comprising a separate bottom-part and a top-part joined together, each of the bottom and top parts having a toe end and a heel end with the toe ends of the top and bottom parts having the same profile, the top-part having a cut-out section extending along a border of the top-part from the heel end toward the toe end of the top part up to the region of the first to the fifth metatarsal-bone-head of a foot properly placed on the orthopedic support, and a border-part connected to at least the bottom-part with the border-part extending along opposing sides of a heel properly placed on the support, the border-part connected to at least a portion of the heel end of the bottom-part.

2. An orthopedic support according to claim 1, wherein a cushion-like member is arranged between the top-part and the border-part.

3. Orthopedic support according to claim 1, wherein an upper-layer is applied onto the top-part.

4. Orthopedic support according to claim 1, wherein the border-part is designed as a closed ring which delineates an insertion-recessed-area.

5. Orthopedic support according to claim 4, wherein the border-part, in its form and dimension, corresponds to the form and dimension of the insertion-recessed-area.

6. Orthopedic support according to claim 4, wherein a reinforcement-component which, in form and dimension, corresponds to those of the top-part is arranged between the bottom-part and the top-part.

7. Orthopedic support according to claim 6, wherein an intermediary layer made of textile material can be placed between the top-part and the reinforcement-component.

* * * * *